US009577396B2

(12) United States Patent
Plamondon et al.

(10) Patent No.: US 9,577,396 B2
(45) Date of Patent: Feb. 21, 2017

(54) KEYSTONE JACK ADAPTOR

(71) Applicant: BELDEN CANADA INC., Saint-Laurent (CA)

(72) Inventors: Jean-Sébastien Plamondon, Laval (CA); Marc Fontaine, Les Cèdres (CA)

(73) Assignee: BELDEN CANADA INC., Saint-Laurent (CA)

( * ) Notice: Subject to any disclaimer, the term of this patent is extended or adjusted under 35 U.S.C. 154(b) by 0 days.

(21) Appl. No.: 15/137,332

(22) Filed: Apr. 25, 2016

(65) Prior Publication Data

US 2016/0315436 A1 Oct. 27, 2016

Related U.S. Application Data

(60) Provisional application No. 62/152,398, filed on Apr. 24, 2015.

(51) Int. Cl.

| | |
|---|---|
| ***H01R 13/627*** | (2006.01) |
| ***H01R 31/06*** | (2006.01) |
| ***H01R 43/20*** | (2006.01) |
| ***H01R 43/28*** | (2006.01) |

(52) U.S. Cl.

CPC ..... *H01R 31/06* (2013.01); *H01R 43/205* (2013.01); *H01R 43/28* (2013.01); *H01R 2201/04* (2013.01)

(58) Field of Classification Search

CPC ..... H01R 31/06; H01R 43/205; H01R 43/28; H01R 221/04

USPC ..... 439/357, 544, 557, 558, 559, 562, 565, 439/567, 571, 676

See application file for complete search history.

(56) References Cited

U.S. PATENT DOCUMENTS

| | | | | |
|---|---|---|---|---|
| 5,169,346 A * | 12/1992 | Johnston | H01R 13/33 | 439/607.31 |
| 5,238,426 A * | 8/1993 | Arnett | H04Q 1/13 | 248/27.3 |
| 5,302,140 A * | 4/1994 | Arnett | H01R 13/743 | 439/544 |
| 6,074,256 A | 6/2000 | Arnett | | |

OTHER PUBLICATIONS

International Search Report of corresponding application No. PCT/CA2016/050476.

* cited by examiner

*Primary Examiner* — Edwin A. Leon
(74) *Attorney, Agent, or Firm* — Hugh Mansfield

(57) ABSTRACT

An adaptor for receiving a keystone type connector and insertion into a patch panel is provided, having a bottom wall with a ridge engaging lower slot and a lower edge engaging channel and a top wall having a flexible tab and a cantilevered latch engaging upper slot and an upper edge engaging channel in the flexible tab. The walls define a keystone modular jack receiving region and opening. The adaptor is dimensioned such that when the lower edge is received in the lower edge engaging channel, the upper edge is releasably engageable by the upper edge engaging channel, thereby releasably securing the adaptor within an aperture in a patch panel.

10 Claims, 6 Drawing Sheets

KEYSTONE JACK ADAPTOR

CROSS REFERENCE TO RELATED APPLICATIONS

This application claims benefit, under 35 U.S.C. §119(e) of U.S. provisional application Ser. No. 62/152,398 filed on Apr. 24, 2015 and which is incorporated herein in its entirety by reference.

FIELD OF THE INVENTION

The present invention relates to a keystone jack adaptor. In particular, the present invention relates to an adaptor such that a keystone jack can be installed via the front of a patch panel.

BACKGROUND OF THE INVENTION

Network cables in data centres are typically terminated by a jack at a patch panel and such that the cable can be interconnected with another cable using a short patch cable. The jacks are exposed along a front of the patch panel in order to provide for easy access to a user and such that the patch cables can be quickly rerouted. As such, the network cables typically arrive at a back of the patch panel where they are interconnected with their respective jacks by an installer. Typically such jacks conform to a keystone format and such that they may be compatible with a number of manufacturers' equipment. One drawback of such keystone jacks is that they can only installed from the back side of the patch panel, and as such the installer must remove the panel in order to first connect the jacks to their respective cables, for example using a punch down tool or the like, and then insert the jacks into the back side of the panel and such that their plug receiving sockets are exposed along a front face of the panel. Alternatively, the installer can attempt to gain access to the back of the panel, but often the spaces are insufficient or the number of existing cables being terminated at adjacent patch panels so dense that an installer has difficulty gaining access.

In order to overcome the above drawbacks, the prior art discloses hinged panels which can be partially moved to gain access to the back. As with conventional patch panels, however, the hinged panels suffer the drawback that once cables have been attached, adding subsequent cables can prove difficult. Additionally, extra cable must be provided in order to allow the hinged panel to swing away from the rack to which it is mounted.

SUMMARY OF THE INVENTION

In order to address the above and other drawbacks, there is provided a front installable patch panel assembly for receiving at least one standardized snap-in keystone modular jack comprising a front surface, a ridge and a cantilevered latch opposite the ridge. The assembly comprises a patch panel comprising at least one rectangular aperture comprising a lower edge and an upper edge, the at least one slot dimensioned larger than the modular jack and such that the modular jack may be passed through the at least one slot in either direction, and an adaptor comprising a pair of opposed like side walls each interconnected along a respective lower edge by a bottom wall and along a respective upper edge by an upper wall, the like side walls, bottom wall and upper wall defining a keystone modular jack receiving region and a 14.5 mm by 16.0 mm opening in a front thereof, the bottom wall comprising a ridge engaging lower slot and a lower edge engaging channel, the upper wall comprising a cantilevered latch engaging upper slot and a flexible tab comprising an upper edge engaging channel extending above the upper wall. The adaptor is dimensioned such that when the lower edge is received in the lower edge engaging channel, the upper edge is releasably engageable by the upper edge engaging channel, thereby releasably securing the adaptor within the at least one rectangular aperture and further wherein when the modular jack is received within the modular jack receiving region by releasably inserting the ridge in the lower slot and the cantilevered latch in the upper slot, the front surface of the modular jack is received within the 14.5 mm by 16.0 mm opening and such that the front surface of the modular jack is substantially flush with the front of the adaptor.

There is also provided an adaptor for insertion into a rectangular aperture comprising a lower edge and an upper edge and for receiving a single standardized snap-in keystone modular jack comprising a front surface, a ridge and a cantilevered latch opposite the ridge. The adaptor comprises a pair of opposed like side walls, a bottom wall comprising a ridge engaging lower slot and a lower edge engaging channel, and a top wall comprising a flexible tab and a cantilevered latch engaging upper slot and an upper edge engaging channel in the flexible tab. Each of the like walls is interconnected along a respective lower edge by the bottom wall and along a respective upper edge by the upper wall the like side walls, bottom wall and upper wall defining a keystone modular jack receiving region and a 14.5 mm by 16.0 mm opening in a front thereof and further wherein the adaptor is dimensioned such that when the lower edge is received in the lower edge engaging channel, the upper edge is releasably engageable by the upper edge engaging channel, thereby releasably securing the adaptor within the at least one rectangular aperture and further wherein when the modular jack is received within the modular jack receiving region by releasably inserting the ridge in the lower slot and the cantilevered latch in the upper slot, the front surface of the modular jack is received within the 14.5 mm by 16.0 mm opening and such that the front surface of the modular jack is flush with the front of the adaptor.

Also, there is provided a method for installing a keystone type jack from the front of a patch panel, the keystone type jack comprising a front surface, a ridge and a cantilevered latch opposite the ridge, the jack for terminating a cable located behind the patch panel, the patch panel comprising a rectangular aperture comprising a lower edge and an upper edge. The method comprises pulling the cable through the rectangular slot, terminating the cable with the keystone type jack, securing the keystone type jack to an adaptor comprising a pair of opposed like side walls each interconnected along a respective lower edge by a bottom wall and along a respective upper edge by an upper wall, the like side walls, bottom wall and upper wall defining a keystone modular jack receiving region and a 14.5 mm by 16.0 mm opening in a front thereof, the bottom wall comprising an inner lower slot and an outer lower channel, the upper wall comprising an inner upper slot, and a flexible tab comprising an outer upper channel extending above the upper wall, by engaging the ridge in the lower slot and the cantilevered latch in the upper slot, and securing the jack and adaptor assembly to the patch panel by engaging the lower edge of the aperture in the lower channel and the upper edge of the aperture in the upper channel.

DETAILED DESCRIPTION OF THE ILLUSTRATIVE EMBODIMENTS

Figure 1B:
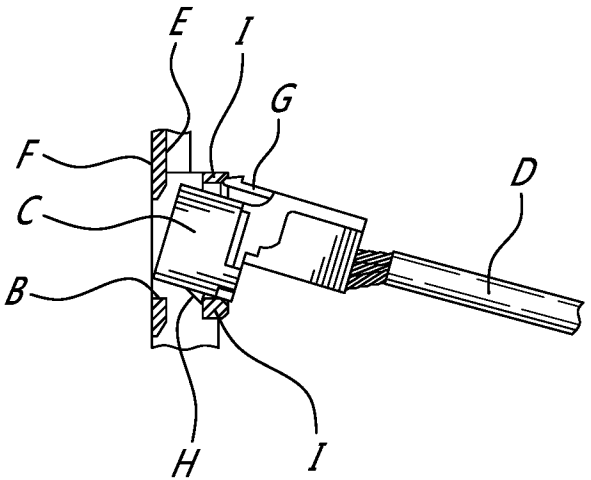
Fig. 1B Prior Art
FIGS. 1A and 1B provide a prior art patch panel and keystone-type connector.
Figure 1A:
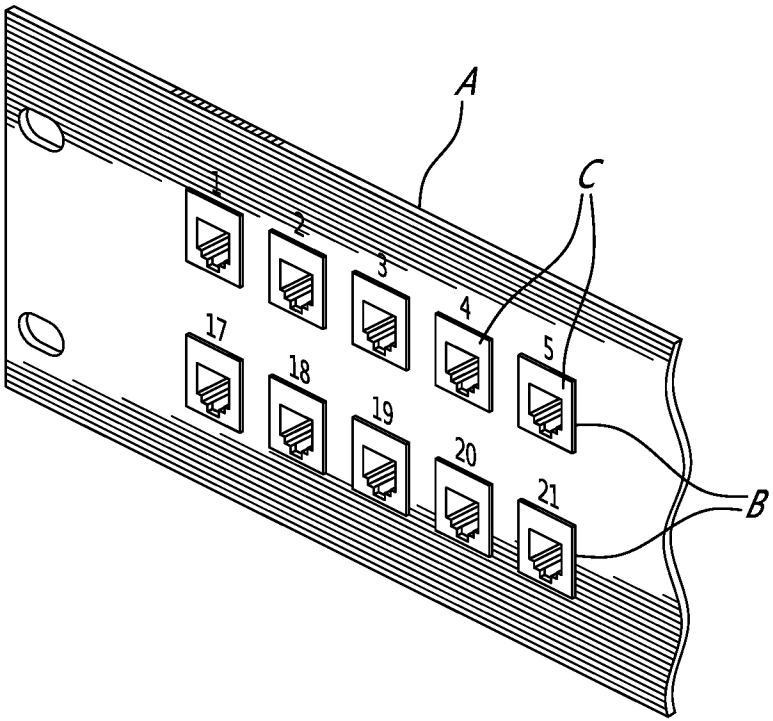
Fig. 1A Prior Art

Referring now to FIG. 1A a prior art patch panel A comprises a plurality of ports B, each accepting a respective modular keystone jack C. Referring to FIG. 1B in addition to FIG. 1A, the modular keystone jacks C each terminate a cable D and are secured to a rearward side E of the panel and such that their front faces are substantially flush with a front F of the panel A. In order to secure the modular keystone jack C to the panel B the modular keystone jack C comprises a cantilevered latch G and raised ridge H which releasably engage complementary structures I moulded into the back of the panel A. As known in the art, modular keystone jacks C have a rectangular face of 14.5 mm wide by 16 mm high. The cantilevered latch G allows each modular keystone jack C to be snapped into the correspondingly-sized rectangular holes, or ports B, in the patch panel A. as shown, such modular keystone jacks C include portions which are dimensioned much wider than their respective ports B, and such that the modular keystone jacks C cannot fit through their respective port B and must therefore necessarily be installed from the back of the panel A. All modular keystone jacks C, regardless of the type of jack they carry, are interchangeable and replaceable. This provides much flexibility in arranging and mounting many different types of jacks (e.g. RJ-45, BNC, RCA, HDMI, F-Connector, Optic Fiber, etc.) in a given panel without requiring customized manufacturing.

Figure 2:
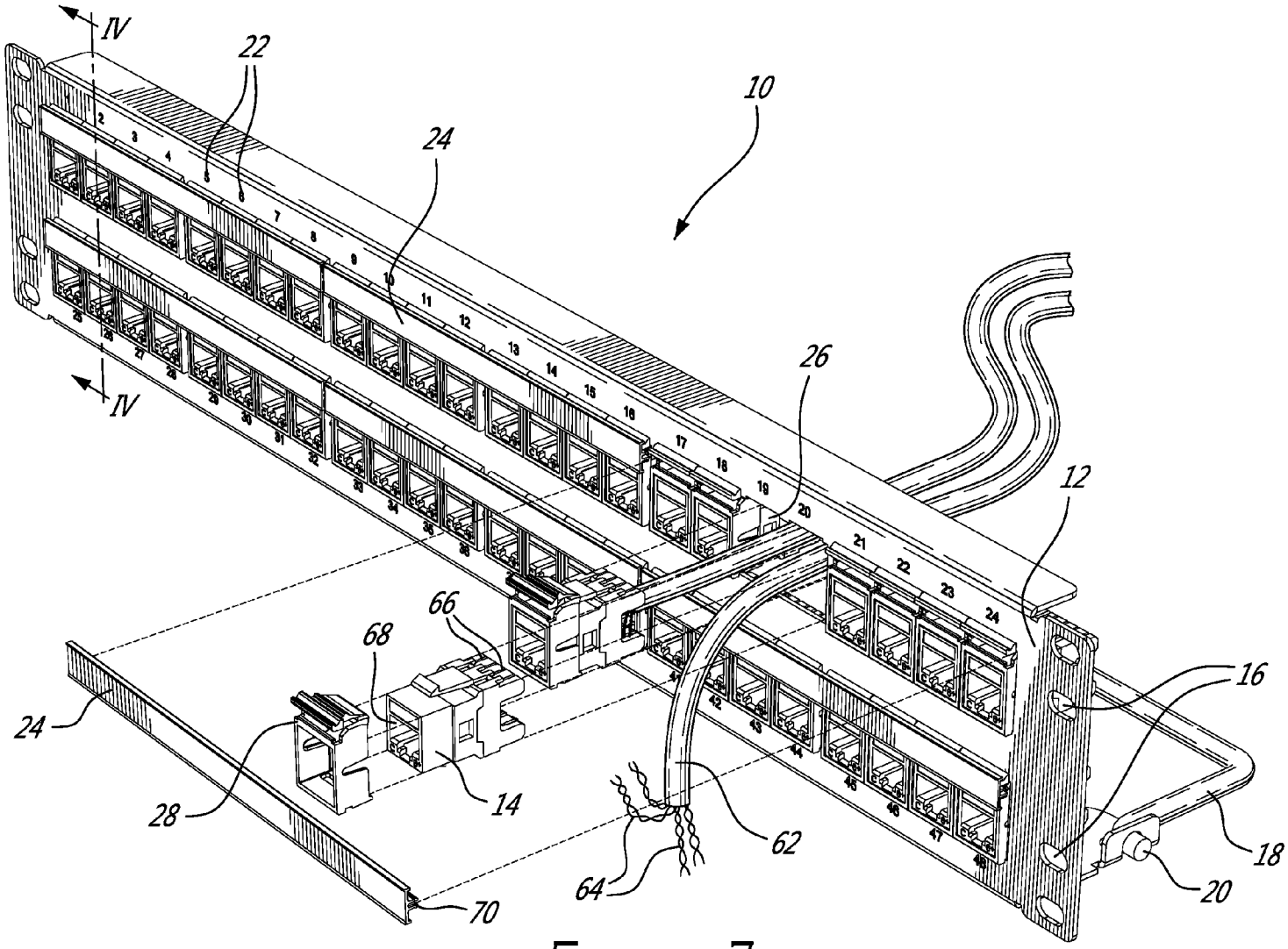
FIG. 2 provides a partially exploded raised right front perspective view a patch panel in accordance with an illustrative embodiment of the present invention.

Referring now to FIG. 2, a patch panel in accordance with an illustrative embodiment of the present invention, and generally referred to using the reference numeral 10, will now be described. The patch panel 10 comprises a frame 12, typically manufactured from sheet steel or the like supporting a plurality of modular keystone jacks 14 exposed along a front face thereof. The frame 12 further comprises a plurality of holes 16 via which the frame 12 can be secured to a 19" rack or the like using bolts (both not shown). A hinged cable support bar 18 is also provided which can be pivoted upward about its hinge 20. A number 22 is typically provided on the face of the panel and adjacent the position of each modular keystone jack 16 for easy identification. Labelling strips 24 may also be provided. Apertures 26 are provided in the frame 12 for receiving one or more modular keystone jacks 14. The apertures 26 are dimensioned larger than the axial dimensions of the modular keystone jacks 14 and such that a jack 14 passes freely through the slot 26. In order to hold each modular keystone jack 14 in its respective slot 26 an adaptor 28 is provided.

Figure 3A:
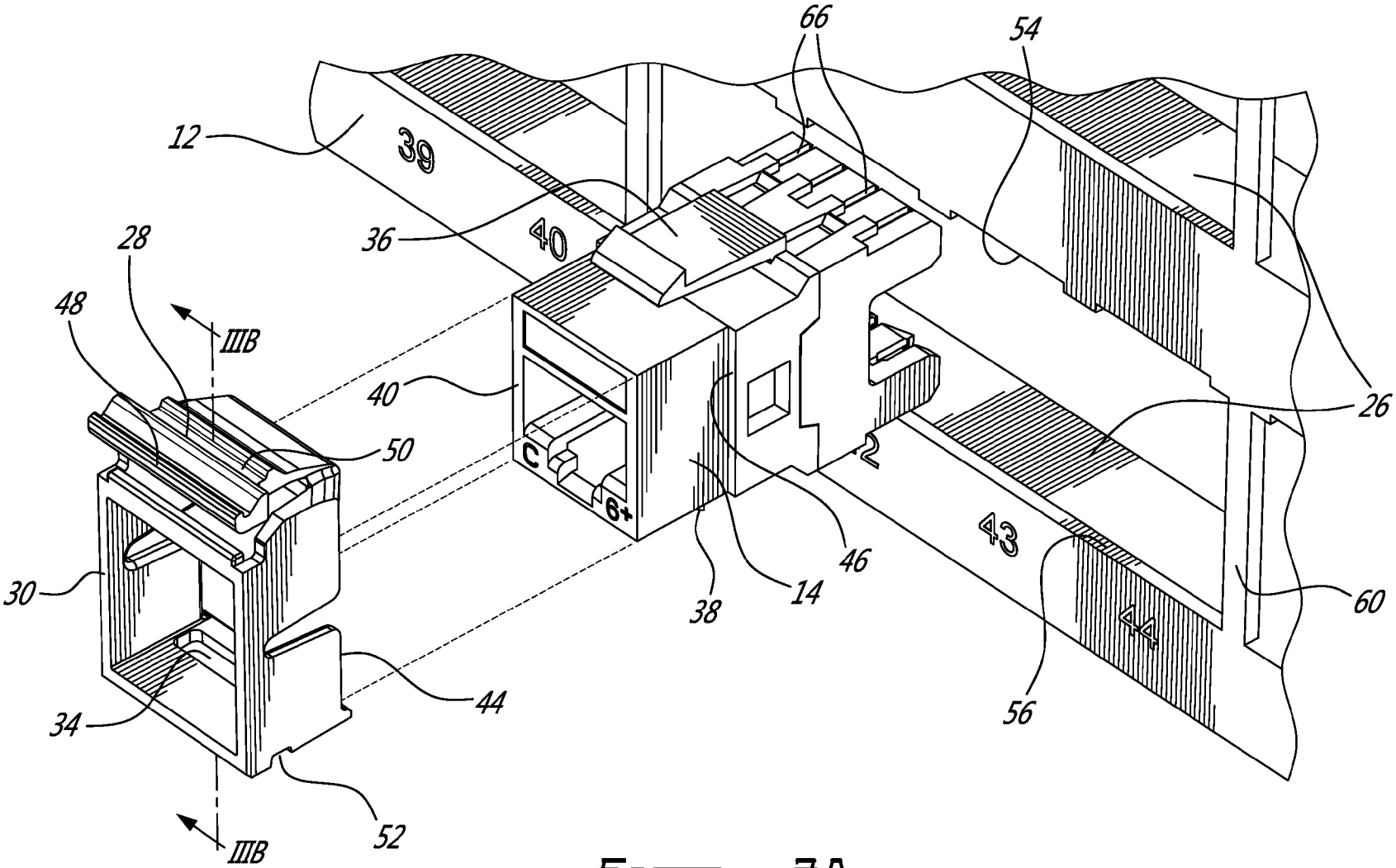
FIG. 3A provides a detailed raised right front exploded perspective view of an adaptor, keystone connector and patch panel in accordance with an illustrative embodiment of the present invention.
Figure 3B:
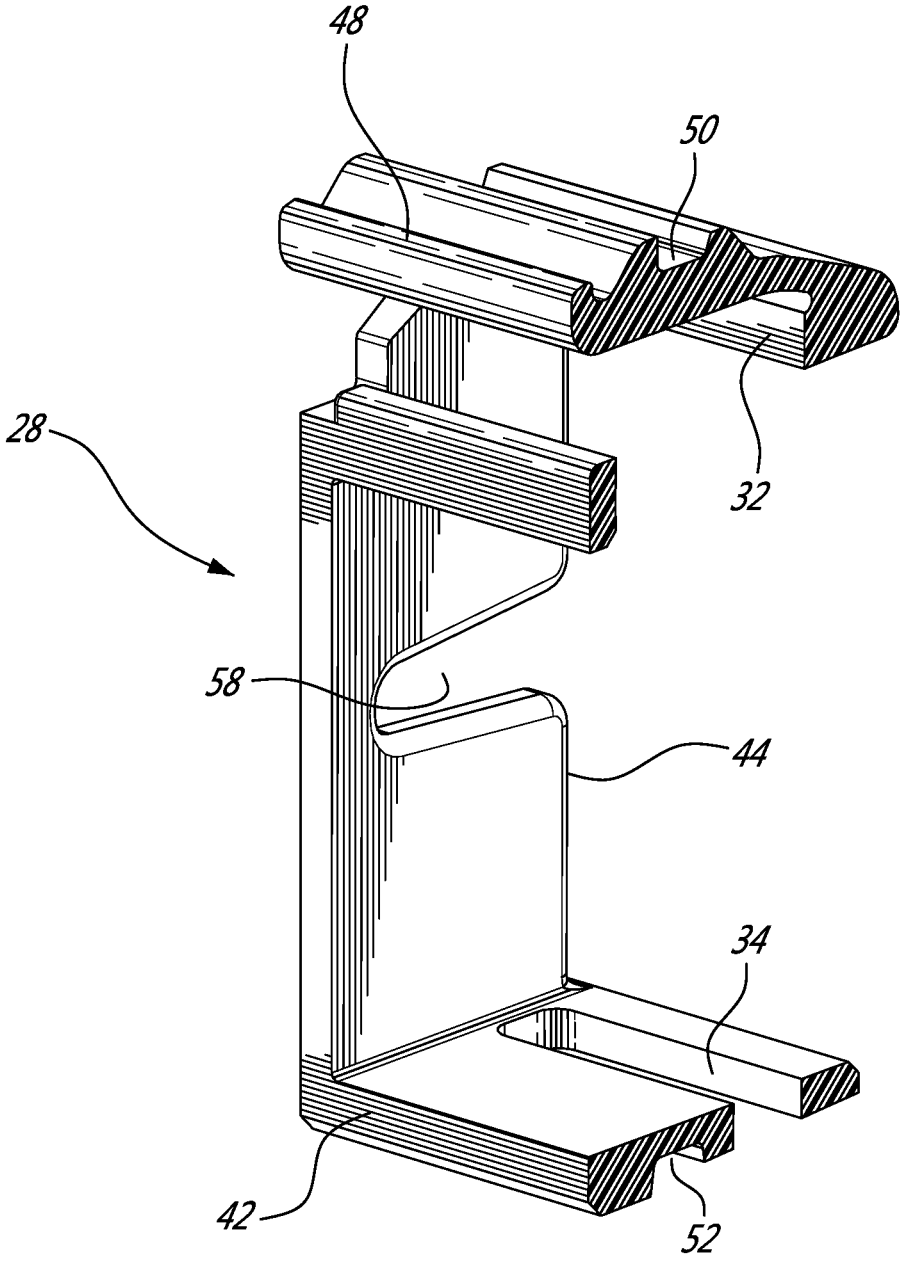
FIG. 3B provides a sectional view of an adaptor taken along line IIIB-IIIB in FIG. 3A.

Referring now to FIGS. 3A and 3B, each adaptor 28 is dimensioned to snugly receive a respective modular keystone jack 14 in an opening 30 thereof. The adaptor 28 comprises and upper slot 32 and a lower slot 34 which respectively engage with a cantilevered latch 36 and ridge 38 on the modular jack 14, thereby removeably securing the modular jack 14 to the adaptor 28 and such that the front face 40 of the modular jack 14 is held flush with the front 42 of the adaptor 28. In order to ensure that the front face 40 of the modular jack 14 is held snuggly and aligned with the front of the adaptor 28, a rear edge 44 of the adaptor 28 engages a shoulder 46 of the modular jack 14 when the modular jack 14 has been fully inserted into the adaptor 28.

Still referring to FIGS. 3A and 3B, the adaptor 28 comprises a flexible tab 48 and a pair of opposed frame engaging channels 50, 52 and such that the adaptor can be releasably secured from the front of the patch panel in a chosen position in the aperture 26 between a top aperture edge 54 and a bottom aperture edge 56. An additional cutaway 58 can be moulded in the adaptor 28 to improve flexibility. As shown, a given aperture 26 can accommodate a plurality of adaptors arranged side-by-side. Illustratively, apertures 26 suitable for accommodating four (4) adaptors 28 are shown. Adjacent apertures 26 are separated from one another by a post 60.

Referring back to FIG. 2, during use the frame 12 is installed to a 19" rack or the like (not shown) and one or more cables to be terminated 62 pulled through the aperture 26 where the modular jack 14 will be installed. Illustratively the cable 62 is a network cable and comprises four (4) twisted pairs of conductors 64. The four (4) twisted pairs of conductors 64 are each connected via a respective Insulation Displacement Connector (IDC) as in 66 exposed on the rearward side of the modular jack 4, for example by using a punch down tool or the like. Each of the IDCs 66 is in turn interconnected with a respective one of a plurality of tines (not shown) exposed within a plug receiving socket 68.

Referring again to FIGS. 3A and 3B in addition to FIG. 2, once the cable 62 has been terminated using the modular jack 14, the modular jack 14 is inserted into a respective adaptor 28 until the cantilevered latch 36 and ridge 38 are seated accordingly in their respective upper slot 32 and lower slot 34 in the adaptor 28. Typically this is done by tilting the adaptor 28 and modular jack 14 such that the ridge 38 is engaged in the lower slot 34 and then rotating the modular jack 14 relative to the adaptor 28 about the ridge 38 and until the cantilevered latch 36 is fully engaged by the upper slot 32. Similarly, the modular jack 14 can be released from the adaptor 28 by depressing the cantilevered latch 36 until it is released from the upper slot 32 and then rotating the modular jack 14 relative to the adaptor 28 about the ridge 38 and away from the adaptor 28.

Once the modular jack 14 is secured within the adaptor 28, the adaptor 28 is positioned within the aperture 26 in a selected position. This is typically done by first positioning a lower one of the frame engaging channels 52 over the bottom aperture edge 56 and then rotating the adaptor 28 relative to the frame about the bottom aperture edge 56 and until the upper one of the frame engaging channels 50 is fully engaged by the top aperture edge 54. Similarly, the adaptor 28 can be realised from the aperture 26 by depressing the flexible tab 48, which disengages the top aperture edge 54 from the upper one of the frame engaging channels 50, and rotating the adaptor 28 about the bottom aperture edge 56 and away from the frame 12.

Figure 4:
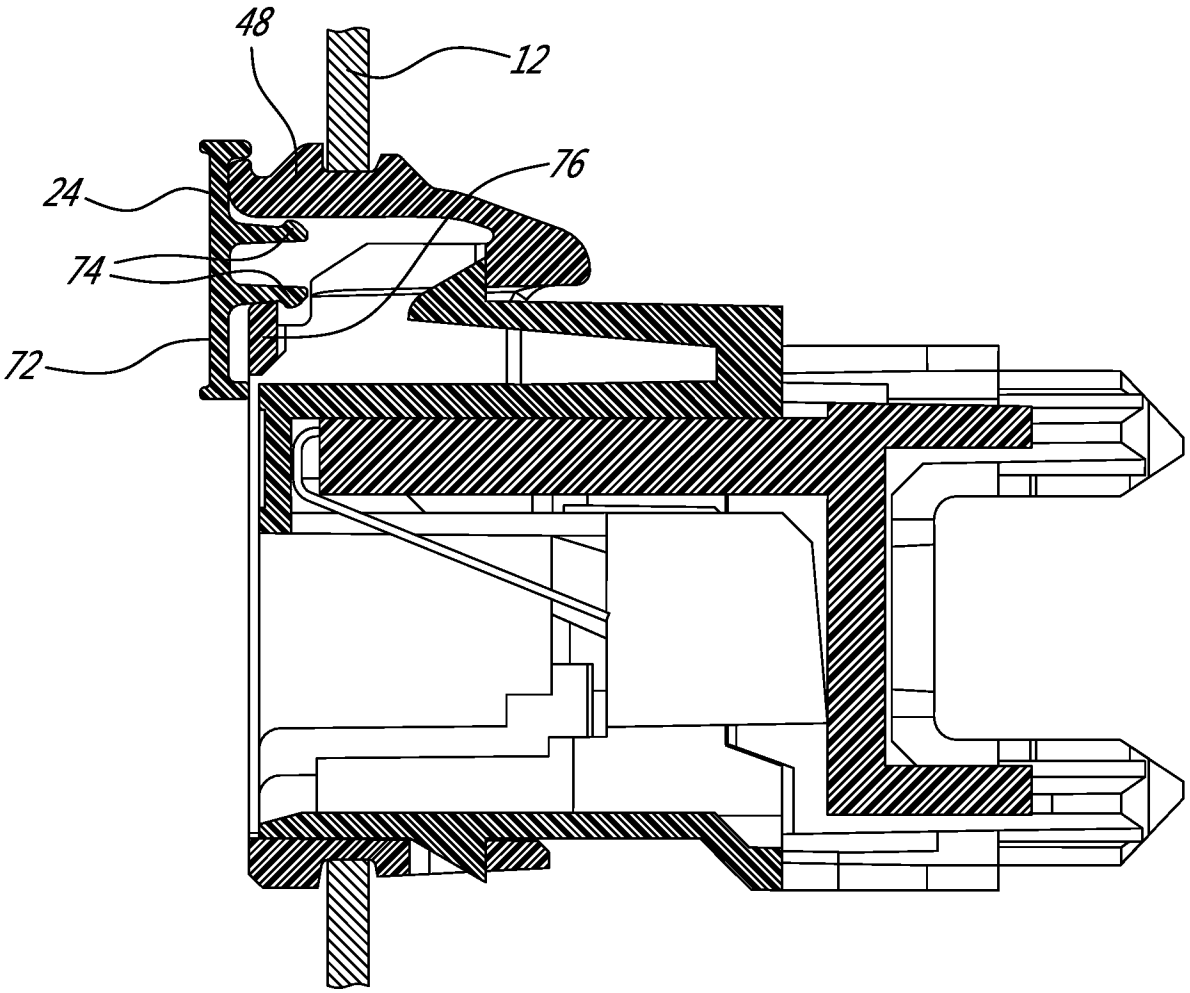
FIG. 4 provides a sectional view of an adaptor and keystone connector assembly taken along line IV-IV in FIG. 4.

Referring back to FIG. 2, once installed, the adaptors 28 can be secured in their respective apertures 26 by using the locking/labelling strip 24. Referring to FIG. 4 in addition to FIG. 2, each locking/labelling strip 24 comprises a display face 70 and a pair of opposed raised flexible fillets 74 running along the length of the labelling strip 24 opposite the display face 72. The labelling strip 24 is installed such that the flexible fillets 74 are positioned between the flexible tab 48 and the adaptor body 76. Positioning the labelling strip 24 in this manner prevents flexible tab 48 from being depressed, thereby preventing inadvertent removal of the adaptor 28 from the frame 12.

Figure 5:
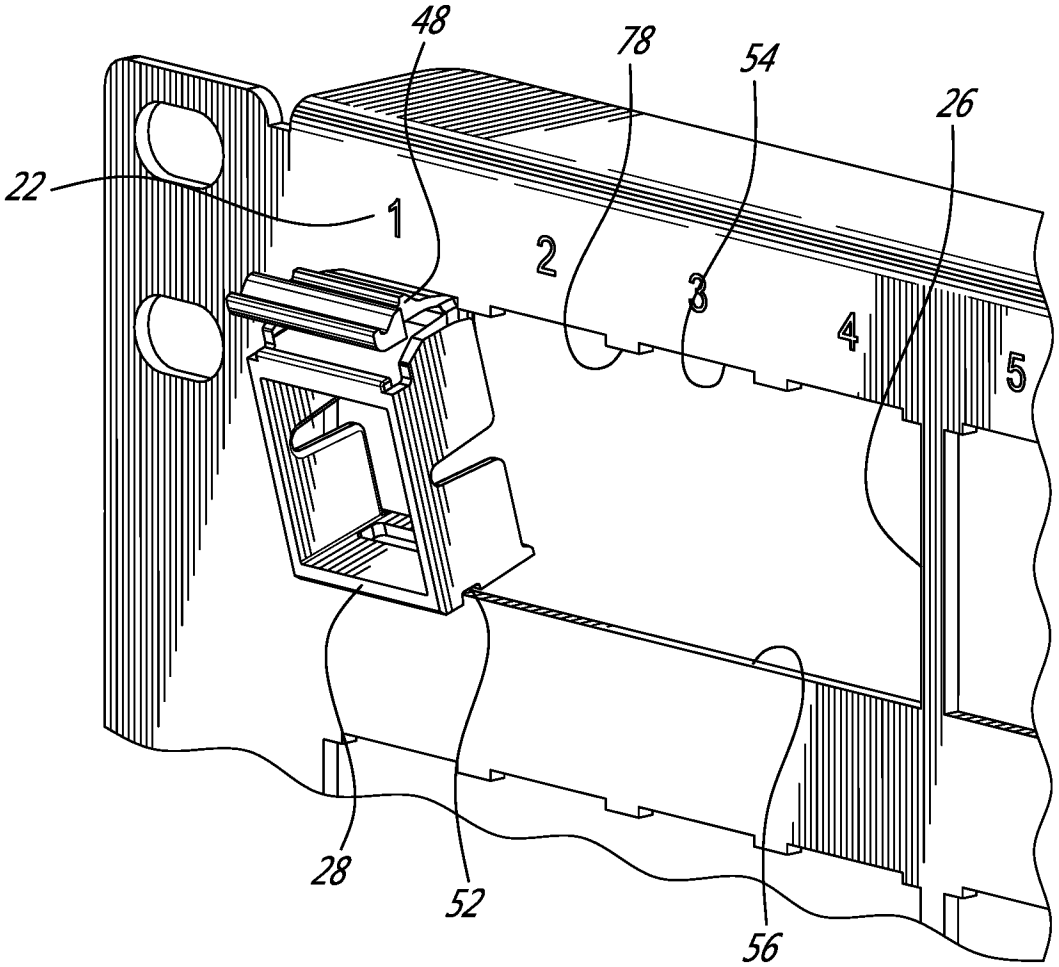
FIG. 5 provides a detailed left raised perspective view of an adaptor and a patch panel in accordance with an illustrative embodiment of the present invention.

Referring now to FIG. 5, in order to assist the user when installing the adaptor 28 into a respective position in an aperture 26, a plurality of adaptor guide tabs 78 are provided along the top aperture edge 54. With the adaptor 28 in the correct orientation, and the frame engaging channel 52 positioned over the bottom aperture edge 56, the adaptor guide tabs 78 serve to guide the flexible lever 48 as the adaptor 28 is rotated into position, and such that the adaptor 28 is positioned correctly adjacent a respective one of the numbers 22. In the event that the adaptor 28 is reversed the adaptor guide tabs 78 prevent the channel 52 from engaging correctly with the top aperture edge 54, thereby providing a mechanical indication to the installer that the adaptor 28 is being incorrectly installed, and thereby preventing the adaptor 28 from being inadvertently inverted when inserted into a respective aperture 26.

Although the present invention has been described herein above by way of specific embodiments thereof, it can be modified without departing from the spirit and nature of the subject invention as defined in the appended claims.

We claim:

1. A front installable patch panel assembly for receiving at least one standardized snap-in keystone modular jack comprising a front surface, a ridge and a cantilevered latch opposite the ridge, the assembly comprising:

a patch panel comprising at least one rectangular aperture comprising a lower edge and an upper edge, said at least one slot dimensioned larger than the modular jack and such that the modular jack may be passed through said at least one slot in either direction; and an adaptor comprising a pair of opposed like side walls each interconnected along a respective lower edge by a bottom wall and along a respective upper edge by an upper wall, said like side walls, bottom wall and upper wall defining a keystone modular jack receiving region and a 14.5 mm by 16.0 mm opening in a front thereof, said bottom wall comprising a ridge engaging lower slot and a lower edge engaging channel, said upper wall comprising a cantilevered latch engaging upper slot and a flexible tab comprising an upper edge engaging channel extending above said upper wall;

wherein said adaptor is dimensioned such that when said lower edge is received in said lower edge engaging channel, said upper edge is releasably engageable by said upper edge engaging channel, thereby releasably securing said adaptor within said at least one rectangular aperture and further wherein when the modular jack is received within said modular jack receiving region by releasably inserting the ridge in said lower slot and the cantilevered latch in said upper slot, the front surface of the modular jack is received within said 14.5 mm by 16.0 mm opening and such that the front surface of the modular jack is substantially flush with said front of said adaptor.

2. The assembly of claim 1, further comprising an adaptor lock for securing said adaptor in said aperture, said adaptor lock comprising a locking strip insertable between said flexible tab and said upper wall thereby preventing said tab from being flexed towards said upper wall and such that said upper edge is released from said upper edge engaging channel.

3. The assembly of claim 2, wherein said adaptor lock further comprises a labelling strip attached at right angles along a length of said locking strip and such that when said adaptor lock is installed, said labelling strip is visible immediately above the front surface of the modular jack.

4. The assembly of claim 1, wherein said aperture is laterally elongate and sized to receive a plurality of said adaptors arranged side by side and further comprising a plurality of said adaptors are arranged side by side in said aperture.

5. The assembly of claim 4, wherein said aperture further comprises a plurality of spaced adaptor guide tabs along an upper edge thereof, one of said tabs arranged at each intersection of adjacent ones of said plurality of adaptors.

6. The assembly of claim 1, wherein said patch panel is a standard 19" patch panel and said like side walls are dimensioned such that 24 of said adaptors may be arranged side by side in said standard patch panel.

7. An adaptor for insertion into a rectangular aperture comprising a lower edge and an upper edge and for receiving a single standardized snap-in keystone modular jack comprising a front surface, a ridge and a cantilevered latch opposite the ridge, the adaptor comprising:

a pair of opposed like side walls;

a bottom wall comprising a ridge engaging lower slot and a lower edge engaging channel; and a top wall comprising a flexible tab and a cantilevered latch engaging upper slot and an upper edge engaging channel in said flexible tab;

wherein each of said like walls is interconnected along a respective lower edge by said bottom wall and along a respective upper edge by said upper wall said like side walls, bottom wall and upper wall defining a keystone modular jack receiving region and a 14.5 mm by 16.0 mm opening in a front thereof and further wherein said adaptor is dimensioned such that when said lower edge is received in said lower edge engaging channel, said upper edge is releasably engageable by said upper edge engaging channel, thereby releasably securing said adaptor within said at least one rectangular aperture and further wherein when the modular jack is received within said modular jack receiving region by releasably inserting the ridge in said lower slot and the cantilevered latch in said upper slot, the front surface of the modular jack is received within said 14.5 mm by 16.0 mm opening and such that the front surface of the modular jack is flush with said front of said adaptor.

8. The adaptor of claim 7, wherein each of said side walls comprises a cutaway in a rear edge thereof.

9. A method for installing a keystone type jack from the front of a patch panel, the keystone type jack comprising a front surface, a ridge and a cantilevered latch opposite the ridge, the jack for terminating a cable located behind the patch panel, the patch panel comprising a rectangular aperture comprising a lower edge and an upper edge, the method comprising:

pulling the cable through the rectangular slot;

terminating the cable with the keystone type jack;

securing the keystone type jack to an adaptor comprising a pair of opposed like side walls each interconnected along a respective lower edge by a bottom wall and along a respective upper edge by an upper wall, said like side walls, bottom wall and upper wall defining a keystone modular jack receiving region and a 14.5 mm by 16.0 mm opening in a front thereof, said bottom wall comprising an inner lower slot and an outer lower channel, said upper wall comprising an inner upper slot, and a flexible tab comprising an outer upper channel extending above said upper wall, by engaging the ridge in said lower slot and the cantilevered latch in said upper slot; and securing the jack and adaptor assembly to the patch panel by engaging the lower edge of the aperture in the lower channel and the upper edge of the aperture in the upper channel.

10. The method of claim 9, further comprising, after said securing, inserting an adaptor lock between said upper wall and said flexible tab.

* * * * *